US008772217B2

(12) United States Patent
Dreilinger et al.

(10) Patent No.: US 8,772,217 B2
(45) Date of Patent: Jul. 8, 2014

(54) ALKALINE HARD SURFACE CLEANING COMPOSITION

(75) Inventors: Lisa Dreilinger, Montvale, NJ (US); Sophie Strzepek, Montvale, NJ (US)

(73) Assignee: Reckitt Benckiser LLC, Parsippany, NJ (US)

( * ) Notice: Subject to any disclaimer, the term of this patent is extended or adjusted under 35 U.S.C. 154(b) by 574 days.

(21) Appl. No.: 12/665,376

(22) PCT Filed: Jun. 11, 2008

(86) PCT No.: PCT/GB2008/001968

§ 371 (c)(1),
(2), (4) Date: Apr. 15, 2010

(87) PCT Pub. No.: WO2008/155518

PCT Pub. Date: Dec. 24, 2008

(65) Prior Publication Data

US 2010/0206328 A1 Aug. 19, 2010

(30) Foreign Application Priority Data

Jun. 21, 2007 (GB) ..... 0711992.8

(51) Int. Cl.

| | |
|---|---|
| ***C11D 3/48*** | (2006.01) |
| *C11D 3/43* | (2006.01) |
| *C11D 3/20* | (2006.01) |
| *C11D 1/75* | (2006.01) |

(52) U.S. Cl.

CPC .. *C11D 3/48* (2013.01); *C11D 3/43* (2013.01); *C11D 3/2068* (2013.01); *C11D 1/75* (2013.01)

USPC ..... 510/238; 510/382; 510/503; 510/506

(58) Field of Classification Search

CPC ..... C11D 3/48; C11D 3/2068; C11D 3/43; C11D 1/75

USPC ..... 510/238, 382, 503, 506

See application file for complete search history.

(56) References Cited

U.S. PATENT DOCUMENTS

| | | | | |
|---|---|---|---|---|
| 2,974,134 | A | 3/1961 | Pollitzer | |
| 3,219,656 | A | 11/1965 | Boettner | |
| 3,598,865 | A | 8/1971 | Lew | |
| 3,640,998 | A | 2/1972 | Mansfield et al. | |
| 3,707,535 | A | 12/1972 | Lew | |
| 3,772,269 | A | 11/1973 | Lew | |
| 3,839,318 | A | 10/1974 | Mansfield | |
| 3,974,138 | A | 8/1976 | Lew | |
| 4,223,129 | A | 9/1980 | Roth et al. | |
| 4,446,161 | A * | 5/1984 | Friedman et al. | 426/335 |
| 4,528,106 | A | 7/1985 | Grolitzer | |
| 4,921,629 | A | 5/1990 | Malihi et al. | |
| 5,080,831 | A * | 1/1992 | VanEenam | 510/365 |
| 5,454,984 | A | 10/1995 | Graubart et al. | |
| 5,650,385 | A * | 7/1997 | Dunn et al. | 510/245 |
| 5,866,528 | A * | 2/1999 | Cala et al. | 510/423 |
| 5,929,007 | A | 7/1999 | Feng | |
| 7,510,859 | B2 * | 3/2009 | Wieland et al. | 435/197 |
| 2002/0004469 | A1 | 1/2002 | Faber | |
| 2002/0037817 | A1 | 3/2002 | Foley et al. | |
| 2002/0082185 | A1 | 6/2002 | Totoki | |
| 2002/0103098 | A1 | 8/2002 | Harrison et al. | |
| 2002/0169090 | A1 | 11/2002 | Foley et al. | |
| 2002/0183222 | A1 | 12/2002 | Foley et al. | |
| 2003/0064910 | A1 | 4/2003 | Fong et al. | |
| 2003/0119689 | A1 | 6/2003 | Hutton et al. | |
| 2003/0130153 | A1 * | 7/2003 | Foley et al. | 510/421 |
| 2004/0121932 | A1 | 6/2004 | Griese et al. | |
| 2004/0122112 | A1 | 6/2004 | Griese et al. | |
| 2004/0224867 | A1 * | 11/2004 | Colurciello et al. | 510/238 |
| 2005/0023392 | A1 | 2/2005 | Hsu et al. | |
| 2005/0227897 | A1 * | 10/2005 | Nelson et al. | 510/407 |
| 2009/0099057 | A1 * | 4/2009 | DeDominicis et al. | 510/405 |
| 2009/0305927 | A1 * | 12/2009 | Binns et al. | 510/100 |
| 2011/0039754 | A1 * | 2/2011 | Dedominicis et al. | 510/362 |
| 2012/0035091 | A9 * | 2/2012 | Dedominicis et al. | 510/362 |

FOREIGN PATENT DOCUMENTS

| | | | |
|---|---|---|---|
| EP | 1305389 | B1 | 5/2003 |
| GB | 2318585 | A | 4/1998 |
| GB | 2417958 | A | 3/2006 |
| WO | 0206436 | A1 | 1/2002 |
| WO | 0208373 | A1 | 1/2002 |
| WO | 0208375 | A1 | 1/2002 |
| WO | 03008528 | A | 1/2003 |
| WO | 03008528 | A1 | 1/2003 |
| WO | 03027218 | A1 | 4/2003 |
| WO | 2007099294 | A | 9/2007 |
| WO | 2007099294 | A1 | 9/2007 |
| WO | 2007144555 | A1 | 12/2007 |

* cited by examiner

*Primary Examiner* — Gregory Webb
(74) *Attorney, Agent, or Firm* — Norris McLaughlin & Marcus PA

(57) ABSTRACT

Improved aqueous, alkaline hard surface cleaning compositions useful in the cleaning of hard surfaces, particularly hard surfaces bearing greasy stains or soils also provide a disinfecting and/or sanitizing benefit to the treated hard surfaces. Preferred compositions comprise amine oxide as the sole surfactant constituent, an alkalinity constituent, preferably an alkanolamine and as the sole organic solvent constituent, an alkylene glycol phenyl ether, an antimicrobially active constituent, and water, optionally further including a dye and/or fragrance composition. The compositions provide excellent cleaning of greasy soils on hard surfaces and provide a disinfecting or sanitizing benefit thereto.

13 Claims, No Drawings

ALKALINE HARD SURFACE CLEANING COMPOSITION

This is an application filed under 35 USC 371 of PCT/GB2008/001968.

The present invention relates to improved cleaning compositions useful in the cleaning of hard surfaces, particularly in the cleaning of hard surfaces.

While the art is replete with a large number of cleaning compositions useful for the cleaning of hard surfaces there nonetheless remains a real and continuing need in the art for further improved cleaning compositions useful in the cleaning of hard surfaces, particularly those having reduced amounts of organic constituents while at the same time providing good cleaning performance.

In one aspect the present invention provides a highly alkaline hard surface cleaning composition particularly adapted to the cleaning of hard surfaces which compositions comprise a cleaning effective amount of an amine oxide surfactant constituent, an alkanolamine constituent, a phenyl containing glycol ether solvent, an antimicrobially active constituent, and water, and optionally minor amounts of one or more constituents which improve one or more aesthetic or functional characteristics of the inventive compositions wherein the said compositions provide excellent cleaning of hard surfaces, particularly hard surfaces laden with greasy soils. In particularly preferred embodiments the inventive compositions are characterized as being essentially free of further organic solvents, except for the essential phenyl containing ether solvent and the alkanolamine constituent. In particularly preferred embodiment the inventive compositions provide a cleaning and/or sanitizing benefit to surfaces, particularly hard surfaces being treated with the composition.

According to a still further aspect of the invention there is provided a highly alkaline hard surface cleaning composition according to the prior inventive aspect which is further characterized as preferably being essentially free of surfactant constituents, except for the essential amine oxide surfactant constituent.

In accordance with a still further aspect of the invention there is provided a highly alkaline hard surface cleaning composition particularly adapted to the cleaning of hard surfaces which compositions exhibit a pH of about 9 or greater, but preferably exhibit a pH of 10 or greater and which comprise at least about 85% wt. water, optionally but preferably at least one detersive surfactants, especially preferably at least one nonionic surfactant constituents with amine oxide surfactants be particularly preferred, an alkalinity constituent, such as an alkanolmine, carbonate an/or bicarbonate compound, and a phenyl containing glycol ether solvent, and further optionally minor amounts of one or more constituents which improve one or more aesthetic or functional characteristics of the inventive compositions wherein the said compositions provide excellent cleaning of hard surfaces, particularly hard surfaces laden with greasy soils. In particularly preferred embodiments the inventive compositions are characterized as being essentially free of further organic solvents, except for the essential phenyl containing ether solvent and when present as an alkalinity constituent, the alkanolamine.

According to a further aspect of the invention there is provided a method for the cleaning of a hard surface, which method comprises the step of:

applying a cleaning effective amount of a highly alkaline hard surface cleaning composition according to any of the prior recited inventive aspects to a hard surface in need of such treatment, and concurrently or subsequently, wiping the surface with a cloth, wipe or wiping article.

According to a further aspect of the invention there is provided a method for the cleaning of greasy soils from a hard surface, which method comprises the step of:

applying a cleaning effective amount of a highly alkaline hard surface cleaning composition according to any of the prior recited inventive aspects to a hard surface in need of such treatment, and concurrently or subsequently, wiping the surface with a cloth, wipe or wiping article.

According to a yet further aspect of the invention there is provided a method of producing an improved cleaning composition as recited herein.

In one aspect of the invention there is provided a highly alkaline hard surface cleaning composition which compositions comprise (preferably consisting essentially of, still more preferably consisting of):

a cleaning effective amount of an amine oxide surfactant constituent, an alkanolamine constituent, a phenyl containing glycol ether solvent, an antimicrobially active constituent, water; and, further optionally, minor amounts of one or more constituents which improve one or more aesthetic or functional characteristics of the inventive compositions.

According to a second aspect of the invention there is provided a highly alkaline hard surface cleaning composition which compositions comprise (preferably consisting essentially of, still more preferably consisting of):

a cleaning effective amount of an amine oxide surfactant constituent, an alkanolamine constituent, a phenyl containing glycol ether solvent, an antimicrobially active constituent, water; and, further optionally, minor amounts of one or more constituents which improve one or more aesthetic or functional characteristics of the inventive compositions, wherein the compositions are characterized in being essentially free of organic cosolvents as described herein.

According to a third aspect of the invention there is provided a highly alkaline hard surface cleaning composition which compositions comprise (preferably consisting essentially of, still more preferably consisting of):

a cleaning effective amount of an amine oxide surfactant constituent, an alkanolamine constituent, a phenyl containing glycol ether solvent, an antimicrobially active constituent, water; and, further optionally, minor amounts of one or more constituents which improve one or more aesthetic or functional characteristics of the inventive compositions, wherein the compositions are characterized in being essentially free of a cosurfactant as described herein.

According to a fourth aspect of the invention there is provided a highly alkaline hard surface cleaning composition which compositions comprise (preferably consisting essentially of, still more preferably consisting of):

a cleaning effective amount of an amine oxide surfactant constituent, an alkanolamine constituent, a phenyl containing glycol ether solvent, an antimicrobially active constituent, water; and, further optionally, minor amounts of one or more constituents which improve one or more aesthetic or functional characteristics of the inventive compositions, wherein the compositions are characterized in being essentially free of organic cosolvents as well as being essentially free of cosurfactants as described herein.

According to a fifth aspect of the invention there is provided a highly alkaline hard surface cleaning composition particularly adapted to the cleaning of hard surfaces which compositions exhibit a pH of about 9 or greater, but preferably exhibit a pH of 10 or greater and which comprises:

at least about 85% wt. water, optionally but preferably at least one detersive surfactants, especially preferably at least one nonionic surfactant constituents with amine oxide surfactants be particularly preferred, an alkalinity constituent, such as an alkanolmine, carbonate an/or bicarbonate compound; and, a phenyl containing glycol ether solvent;

an antimicrobially active constituent;

and optionally, further minor amounts of one or more constituents which improve one or more aesthetic or functional characteristics of the inventive compositions wherein the said compositions provide excellent cleaning of hard surfaces, particularly hard surfaces laden with greasy soils.

According to a sixth aspect of the invention there is provided a highly alkaline hard surface cleaning composition particularly adapted to the cleaning of hard surfaces which compositions exhibit a pH of about 9 or greater, but preferably exhibit a pH of 10 or greater according to any of the foregoing aspects of the invention which in addition to a cleaning benefit, also provides a disinfecting or sanitizing benefit to surfaces treated with the said composition.

According to a seventh aspect of the invention there is provided an improved method for the manufacture of a highly alkaline hard surface cleaning composition according to any of the inventive aspects described herein.

According to an eighth aspect of the invention there is provided an improved method for the cleaning treatment of a hard surface in need of same, particularly a greasy soil laden hard surface, which method comprises the step of applying a cleaning effective amount of a highly alkaline hard surface cleaning composition according to any of the inventive aspects described herein.

These and further aspects of the invention will be more clearly understood from a reading of the following specification.

The inventive compositions necessarily comprise a cleaning effective amount of at least one amine oxide surfactant, and may optionally further comprise at least one further detersive surfactants selected from anionic, nonionic, cationic amphoteric or zwitterionic detersive surfactants with one or more further one further nonionic surfactants being especially preferred.

Exemplary amine oxides useful in the compositions of the invention include:

A) Alkyl di(lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di(hydroxy lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and D) Alkylmorpholine oxides in which the alkyl group has about 10-20, and preferably 12-16 carbon atoms, and can be straight or branched chain, saturated or unsaturated.

Preferably the amine oxide constituent is an alkyl di (lower alkyl) amine oxide as denoted above and which may be represented by the following structure:

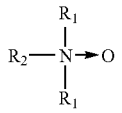

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{1-2}$ alkyl group.

Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{1-2}$ alkyl groups and at least 25% wt. of $C_{1-4}$ alkyl groups, with not more than 15% wt. of $C_{16}$, $C_{18}$ or higher alkyl groups as the $R_2$ group.

The amine oxide constituent may be a single amine oxide, or may be comprised of a plurality of amine oxide compounds and is necessarily present in the inventive cleaning compositions of the invention in amounts of from about 0.01%-10% by weight, more desirably from about 0.25%-5% by weight, yet most preferably from about 0.25%-3.5% wt. based on the total weight of the compositions of which they form a part.

According to certain particularly preferred embodiments, the sole surfactant constituent present in the inventive composition is an amine oxide surfactant constituent and further surfactant constituents are expressly excluded.

In further preferred embodiments one or more further surfactant constituents different than the amine oxide constituents may be present. Useful further surfactants which may be present in the presence of the amine oxide, or in the absence of the amine oxide surfactant constituent include one or more surfactants selected from one or more further anionic, nonionic, cationic, amphoteric or zwitterionic surfactants, of which one or more of the following nonionic surfactants are particularly preferred.

Exemplary of anionic surfactants which may be present include alcohol sulfates and sulfonates, alcohol phosphates and phosphonates, alkyl ester sulfates, alkyl diphenyl ether sulfonates, alkyl sulfates, alkyl ether sulfates, sulfate esters of an alkylphenoxy polyoxyethylene ethanol, alkyl monoglyceride sulfates, alkyl sulfonates, alkyl ether sulfates, alpha-olefin sulfonates, beta-alkoxy alkane sulfonates, alkyl ether sulfonates, ethoxylated alkyl sulfonates, alkylaryl sulfonates, alkylaryl sulfates, alkyl monoglyceride sulfonates, alkyl carboxylates, alkyl ether carboxylates, alkyl alkoxy carboxylates having 1 to 5 moles of ethylene oxide, alkylpolyglycolethersulfates (containing up to 10 moles of ethylene oxide), sulfosuccinates, octoxynol or nonoxynol phosphates, taurates, fatty taurides, fatty acid amide polyoxyethylene sulfates, acyl glycerol sulfonates, fatty oleyl glycerol sulfates, alkyl phenol ethylene oxide ether sulfates, paraffin sulfonates, alkyl phosphates, isethionates, N-acyl taurates, alkyl succinamates and sulfosuccinates, alkylpolysaccharide sulfates, alkylpolyglucoside sulfates, alkyl polyethoxy carboxylates, and sarcosinates or mixtures thereof. These anionic surfactants may be provided as salts with one or more organic counterions, e.g, ammonium, or inorganic counteraions, especially as salts of one or more alkaline earth or alkaline earth metals, e.g, sodium.

Sarcosinate surfactants which are alkali metal salts of N-alkyl-N-acyl amino acids. These are salts derived from the reaction of (1) N-alkyl substituted amino acids of the formula:

$$R_1—NH—CH_2—COOH$$

where $R_1$ is a linear or branched chain lower alkyl of from 1 to 4 carbon atoms, especially a methyl, for example, aminoacetic acids such as N-methylaminoacetic acid (i.e. N-methyl glycine or sarcosine), N-ethyl-aminoacetic acid, N-butylaminoacetic acid, etc., with (2) saturated natural or synthetic fatty acids having from 8 to 18 carbon atoms, especially from 10 to 14 carbon atoms, e.g. lauric acid, and the like.

The resultant reaction products are salts which may have the formula:

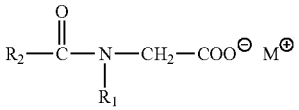

where M is an alkali metal ion such as sodium, potassium or lithium; $R_1$ is as defined above; and wherein $R_2$ represents a hydrocarbon chain, preferably a saturated hydrocarbon chain, having from 7 to 17 carbon atoms, especially 9 to 13 carbon atoms of the fatty acyl group

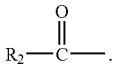

Exemplary useful sarcosinate surfactants include cocoyl sarcosinate, lauroyl sarcosinate, myristoyl sarcosinate, palmitoyl sarcosinate, stearoyl sarcosinate and oleoyl sarcosinate, and tallow sarcosinate. Such materials are also referred to as N-acyl sarcosinates.

Further examples of anionic surfactants include water soluble salts or acids of the formula $(ROSO_3)_xM$ or $(RSO_3)_xM$ wherein R is preferably a $C_6$-$C_{24}$ hydrocarbyl, preferably an alkyl or hydroxyalkyl having a $C_{10}$-$C_{20}$ alkyl component, more preferably a $C_{12}$-$C_{18}$ alkyl or hydroxyalkyl, and M is H or a mono-, di- or tri-valent cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperidinium cations and quaternary ammonium cations derived from alkylamines such as ethylamine, diethylamine, triethylamine, and mixtures thereof, and the like) and x is an integer, preferably 1 to 3, most preferably 1. Materials sold under the Hostapur and Biosoft trademarks are examples of such anionic surfactants.

Still further examples of anionic surfactants include alkyl-diphenyl-ethersulphonates and alkyl-carboxylates.

Also useful as anionic surfactants are diphenyl disulfonates, and salt forms thereof, such as a sodium salt of diphenyl disulfonate commercially available as Dowfax® 3B2. Such diphenyl disulfonates are included in certain preferred embodiments of the invention in that they provide not only a useful cleaning benefit but concurrently also provide a useful degree of hydrotropic functionality.

Other anionic surfactants can include salts (including, for example, sodium, potassium, ammonium, and substituted ammonium salts such as mono-, di- and triethanolamine salts) of soap, $C_6$-$C_{20}$ linear alkylbenzenesulfonates, $C_6$-$C_{22}$ primary or secondary alkanesulfonates, $C_6$-$C_{24}$ olefinsulfonates, sulfonated polycarboxylic acids prepared by sulfonation of the pyrolyzed product of alkaline earth metal citrates, $C_6$-$C_{24}$ alkylpolyglycolethersulfates, alkyl ester sulfates such as $C_{14-16}$ methyl ester sulfates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$-$C_{18}$ monoesters) diesters of sulfosuccinate (especially saturated and unsaturated $C_6$-$C_{14}$ diesters), acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO^-M^+$ wherein R is a $C_8$-$C_{22}$ alkyl, k is an integer from 0 to 10, and M is a soluble salt-forming cation. Examples of the foregoing anionic surfactants are available under the following tradenames: Rhodapon®, Stepanol®, Hostapur®, Surfine®, Sandopan®, Neodox®, Biosoft®, and Avanel®.

An anionic surfactant compound which may be particularly useful in the inventive compositions when the compositions are at a pH of 2 or less are one or more anionic surfactants based on alphasulphoesters including one or more salts thereof. Such particularly preferred anionic surfactants may be represented by the following general structures:

(A)

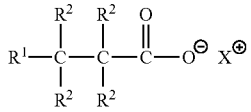

(B)

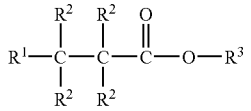

wherein, in each of the foregoing:

$R^1$ represents a $C_6$-$C_{22}$ alkyl or alkenyl group;

each of $R^2$ is either hydrogen, or if not hydrogen is a $SO_3^-$ having associated with it a cation, $X^+$, which renders the compound water soluble or water dispersible, with X preferably being an alkali metal or alkaline earth metal especially sodium or potassium, especially sodium, with the proviso that at least one $R^2$, preferably at least two $R^2$ is a $(SO_3^-)$ having an associated cation $X^+$, and, $R^3$ represents a $C_1$-$C_6$, preferably $C_1$-$C_4$ lower alkyl or alkenyl group, especially methyl.

According to certain preferred embodiments, anionic surfactants are however expressly excluded from the compositions of the present invention.

One class of exemplary useful nonionic surfactants are polyethylene oxide condensates of alkyl phenols. These compounds include the condensation products of alkyl phenols having an alkyl group containing from about 6 to 12 carbon atoms in either a straight chain or branched chain configuration with ethylene oxide, the ethylene oxide being present in an amount equal to 5 to 25 moles of ethylene oxide per mole of alkyl phenol. The alkyl substituent in such compounds can be derived, for example, from polymerized propylene, diisobutylene and the like. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

Further useful nonionic surfactants include the condensation products of aliphatic alcohols with from about 1 to about 60 moles of ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5 (also available as Teric G9A5), which is described in product literature from Sasol as a $C_{8-10}$ having an average molecular weight of 356, an ethylene oxide content of about 4.85 moles (about 60 wt. %), and an HLB of about 12; Alfonic® 810-2, which is described in product literature from Sasol as a $C_{8-10}$ having an average molecular weight of 242, an ethylene oxide content of about 2.1 moles (about 40 wt. %), and an HLB of about 12; and Alfonic® 610-3.5, which is described in product literature from Sasol as having an average molecular weight of 276, an ethylene oxide content of about 3.1 moles (about 50 wt. %), and an HLB of 10. Product literature from Sasol also identifies that the numbers in the alcohol ethoxylate name designate the carbon chain length (numbers before the hyphen) and the average moles of ethylene oxide (numbers after the hyphen) in the product.

Further exemplary useful nonionic surfactants include ethoxylated available from Shell Chemical Company which are described as $C_9$-$C_{11}$ ethoxylated alcohols and marketed under the Neodol® tradename. The Neodol® 91 series nonionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Still further examples of ethoxylated alcohols include the Rhodasurf® DA series nonionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

Further examples of ethoxylated alcohols include those from Tomah Products (Milton, Wis.) under the Tomadol tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear C9/C10/C11 and n is 2.5, 6, or 8; 1-3; 1-5; 1-7; 1-73B; 1-9;—where R is linear C11 and n is 3, 5, 7 or 9; 23-1; 23-3; 23-5; 23-6.5—where R is linear C12/C13 and n is 1, 3, 5, or 6.5; 25-3; 25-7; 25-9; 25-12—where R is linear C12/C13 C14/C15 and n is 3, 7, 9, or 12; and 45-7; 45-13—where R is linear C14/C15 and n is 7 or 13.

Other examples of useful nonionic surfactants include those having a formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from about 1 to about 12. Surfactants of this formula are presently marketed under the Genapol® tradename. available from Clariant, Charlotte, N.C., include the 26-L series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1,26-L-1.6, 26-L-2,26-L-3,26-L-5,26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{1-4}$ alcohols, such as 24-L-3,24-L-45, 24-L-50, 24-L-60, 24-L-60N, 24-L-75, 24-L-92, and 24-L-98N. From product literature, the single number following the "L" corresponds to the average degree of ethoxylation (numbers between 1 and 5) and the two digit number following the letter "L" corresponds to the cloud point in ° C. of a 1.0 wt. % solution in water.

A further class of nonionic surfactants which are contemplated to be useful include those based on alkoxy block copolymers, and in particular, compounds based on ethoxy/propoxy block copolymers. Polymeric alkylene oxide block copolymers include nonionic surfactants in which the major portion of the molecule is made up of block polymeric $C_2$-$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO\text{-}(EO)_x(PO)_y(EO)_z\text{—}H \quad (A)$$

where

EO represents ethylene oxide,

PO represents propylene oxide, y equals at least 15, $(EO)_{x+y}$ equals 20 to 50% of the total weight of said compounds, and, the total molecular weight is preferably in the range of about 2000 to 15,000. These surfactants are available under the PLURONIC tradename from BASF or Emulgen from Kao.

Another group of nonionic surfactants appropriate for use in the new compositions can be represented by the formula (B):

$$R\text{-}(EO,PO)_a(EO,PO)_b\text{—}H \quad (B)$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula (C) as follows:

$$RO—(BO)_n(EO)_x—H \quad (C)$$

wherein

R is an alkyl group containing I to 20 carbon atoms, n is about 5-15 and x is about 5-15.

Also useful as the nonionic block copolymer surfactants, which also include polymeric butoxy groups, are those which may be represented by the following formula (D):

$$HO\text{-}(EO)_x(BO)_n(EO)_y—H \quad (D)$$

wherein n is about 5-15, preferably about 15, x is about 5-15, preferably about 15, and y is about 5-15, preferably about 15.

Still further useful nonionic block copolymer surfactants include ethoxylated derivatives of propoxylated ethylene diamine, which may be represented by the following formula:

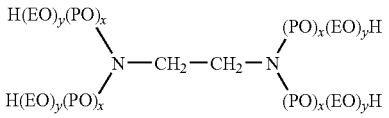

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

The highly alkaline hard surface cleaning compositions may also include one or more amphoteric surfactants. By way of non-limiting example exemplary amphoteric surfactants which are contemplated to be useful in the cosurfactant constituent include one or more water-soluble betaine surfactants which may be represented by the general formula:

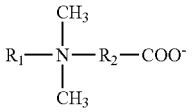

wherein $R_1$ is an alkyl group containing from 8 to 18 carbon atoms, or the amido radical which may be represented by the following general formula:

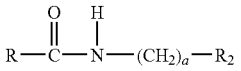

wherein R is an alkyl group having from 8 to 18 carbon atoms, a is an integer having a value of from 1 to 4 inclusive, and $R_2$ is a $C_1$-$C_4$ alkylene group. Examples of such water-soluble betaine surfactants include dodecyl dimethyl betaine, as well as cocoamidopropylbetaine.

The inventive compositions may also include an one or more alkylpolyglucosides which are to be understood as including alkylmonoglucoside and alkylpolyglucoside surfactants based on a polysaccharide, which are preferably one or more alkyl polyglucosides. These materials may also be referred to as alkyl monoglucosides and alkylpolyglucosides. Suitable alkyl polyglucosides are known nonionic surfactants which are alkaline and electrolyte stable. Such include alkyl glucosides, alkyl polyglucosides and mixtures thereof. Alkyl glucosides and alkyl polyglucosides can be broadly defined as condensation articles of long chain alcohols, e.g., $C_8$-$C_{30}$ alcohols, with sugars or starches or sugar or starch polymers i.e., glucosides or polyglucosides. These compounds can be represented by the formula $(S)_n$—O—R wherein S is a sugar moiety such as glucose, fructose, mannose, and galactose; n is an integer of from about 1 to about 1000, and R is a $C_{8-30}$ alkyl group. Examples of long chain alcohols from which the alkyl group can be derived include decyl alcohol, cetyl alcohol, stearyl alcohol, lauryl alcohol, myristyl alcohol, oleyl alcohol and the like.

Alkyl mono- and polyglucosides are prepared generally by reacting a monosaccharide, or a compound hydrolyzable to a monosaccharide with an alcohol such as a fatty alcohol in an acid medium. Various glucoside and polyglucoside compounds including alkoxylated glucosides and processes for making them are disclosed in U.S. Pat. No. 2,974,134; U.S. Pat. No. 3,219,656; U.S. Pat. No. 3,598,865; U.S. Pat. No. 3,640,998; U.S. Pat. No. 3,707,535; U.S. Pat. No. 3,772,269; U.S. Pat. No. 3,839,318; U.S. Pat. No. 3,974,138; U.S. Pat. No. 4,223,129; and U.S. Pat. No. 4,528,106.

Exemplary useful alkyl glucoside surfactants suitable for use in the practice of this invention may be represented by formula I below:

$$RO—(R_1O)_y—(G)_xZ_b \quad I$$

wherein:

R is a monovalent organic radical containing from about 6 to about 30, preferably from about 8 to about 18 carbon atoms;

$R_1$ is a divalent hydrocarbon radical containing from about 2 to about 4 carbon atoms;

O is an oxygen atom;

y is a number which has an average value from about 0 to about 1 and is preferably 0;

G is a moiety derived from a reducing saccharide containing 5 or 6 carbon atoms; and x is a number having an average value from about 1 to 5 (preferably from 1.1 to 2);

Z is $O_2M^1$,

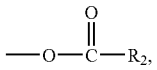

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, —$CH_2OH$, is oxidized to form a

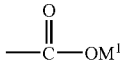

group);

b is a number of from 0 to 3x+1 preferably an average of from 0.5 to 2 per glycosal group;

p is 1 to 10, $M^1$ is $H^+$ or an organic or inorganic cation, such as, for example, an alkali metal, ammonium, monoethanolamine, or calcium.

As defined in Formula I above, R is generally the residue of a fatty alcohol having from about 8 to 30 and preferably 8 to 18 carbon atoms.

Further exemplary useful alkylpolyglucosides include those according to the formula II:

$$R_2O—(C_nH_{2n}O)_r—(Z)_x \quad \text{II}$$

wherein:

$R_2$ is a hydrophobic group selected from alkyl groups, alkylphenyl groups, hydroxyalkylphenyl groups as well as mixtures thereof, wherein the alkyl groups may be straight chained or branched, and which contain from about 8 to about 18 carbon atoms, n has a value of 2-8, especially a value of 2 or 3; r is an integer from 0 to 10, but is preferably 0, Z is derived from glucose; and, x is a value from about 1 to 8, preferably from about 1.5 to 5.

Preferably the alkylpolyglucosides are nonionic fatty alkylpolyglucosides which contain a straight chain or branched chain $C_8$-$C_{15}$ alkyl group, and have an average of from about 1 to 5 glucose units per fatty alkylpolyglucoside molecule. More preferably, the nonionic fatty alkylpolyglucosides which contain straight chain or branched $C_8$-$C_{15}$ alkyl group, and have an average of from about 1 to about 2 glucose units per fatty alkylpolyglucoside molecule.

Examples of such alkylpolyglucosides as described above include, for example, APG™ 325 which is described as being a $C_9$-$C_{11}$ alkyl polyglucoside, also commonly referred to as D-glucopyranoside, (ex. Cognis). Further exemplary alkylpolyglucosides include Glucopon® 625 CS which is described as being a $C_{10}$-$C_{16}$ alkyl polyglucoside, also commonly referred to as a D-glucopyranoside, (ex. Cognis), lauryl polyglucoside available as APG™ 600 CS and 625 CS (ex. Cognis) as well as other materials sold under the Glucopon® tradename, e.g., Glucopon® 215, Glucopon® 225, Glucopon® 425, especially one or more of the alkyl polyglucosides demonstrated in one or more of the examples. It is believed that the alkylpolyglucoside surfactants sold under the Glucopon® tradename are synthesized at least in part on synthetically produced starting constituents and are colorless or only slightly colored, while those sold under the APG™ are synthesized at least in part on naturally occurring or sourced starting constituents and are more colored in appearance.

When present in the inventive compositions, the one or more surfactants other than the amine oxide surfactant constituent are desirably present in the hard surface cleaning compositions of the invention in amounts of from about 0.01%-10% by weight, more desirably from about 0.25%-5% by weight, yet most preferably from about 0.25-3.5% wt. based on the total weight of the compositions of which they form a part. It is to be understood that these weight percentages are in addition to the weight percentages of the amine oxide constituent which may be independently present, or absent, from the inventive compositions.

Particularly preferred surfactant constituents and weight percentages are described with reference to one or more of the Examples.

The highly alkaline inventive compositions necessarily also necessarily comprise an alkalinity constituent such as one or more of an alkanolamine, or an inorganic compound such as one or more alkali metal salts of various inorganic acids, such as alkali metal silicates, metasilicates, polysilicates, borates, carbonates, bicarbonates, hydroxides, and mixtures of same.

Advantageously the alkalinity constituent is an alkanolamine constituent which provides alkalinity to the compositions, as well as simultaneously providing excellent removal of hydrophobic soils which may be encountered, e.g., greases and oils. Exemplary useful alkanolamines include monoalkanolamines, dialkanolamines, trialkanolamines, and alkylalkanolamines such as alkyl-dialkanolamines, and dialkylmonoalkanolamines. The alkanol and alkyl groups are generally short to medium chain length, that is, from 1 to 7 carbons in length. For di- and trialkanolamines and dialkylmonoalkanolamines, these groups can be combined on the same amine to produce for example, methylethylhydroxypropylhydroxylamine. One of skill can readily ascertain other members of this group. The alkanolamine constituent may be a single alkanolamine, or may be a plurality of alkanolamines as well, and may be used in conjunction with one or more of the foregoing inorganic compounds which may also be used as an alkalinity constituent.

Desirably the alkalinity constituent is present in the hard surface cleaning compositions of the invention in amounts of from about 0.01%-10% by weight, more desirably from about 0.01%-2% by weight, and most preferably from about 0.01-1% wt. based on the total weight of the compositions of which they form a part.

Particularly preferred as the alkalinity constituent is monoethanolamine which has found to be effective both as an alkalinity source and as a cleaning component. In certain particularly preferred embodiments the alkalinity constituent of the invention consists solely of a single alkanolamine, preferably selected from monoalkanolamines, dialkanolamines, trialkanolamines of 1 to 7 carbons in length, preferably is a single monoalkanolamine selected from linear monoethanolamine, monopropanolamine or monobutanolamine, and especially preferably is monoethanolamine.

The inventive compositions also necessarily comprise a phenyl containing glycol ether solvent. These solvents may be distinguished from commonly utilized alkylene glycol ether solvents in that they contain a phenyl group in their structure, and may be also termed as alkylene glycol phenyl ethers. Such phenyl containing glycol ether solvents are typically very slow evaporating materials which are also highly hydrophobic and exhibit very poor miscibility in water. Such properties have dissuaded their use in highly aqueous cleaning compositions, such as prior art hard surface cleaning compositions. The present inventors have surprisingly found however that according to the compositions of the present invention, such phenyl containing glycol ether solvents may be readily dispersed in highly aqueous and highly alkaline compositions and further, that such phenyl containing glycol ether solvents even when dissolved or dispersed in such highly aqueous compositions provide a surprising cleaning benefit to hard surfaces, particularly to greasy soil laden hard surfaces. An exemplary greasy soil is that described in the following examples. The inventors have also surprisingly found that such compositions are also stable over time under adverse storage conditions, e.g., at reduced temperatures, including below freezing, as well as elevated temperatures. Such are particularly advantageous properties not only from a technical cleaning performance standpoint but from a commercial standpoint as well as such suggests good long term storage an shelf stability without separation of the highly hydrophobic phenyl containing glycol ether solvents from the largely aqueous compositions of which they form a part.

Exemplary useful phenyl containing glycol ether solvents include those which may be represented by the following general structural representation (I):

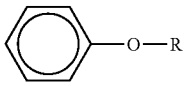

(I)

wherein R is a $C_1$-$C_6$ alkyl group which contains at least one —OH moiety, and preferably R is selected from: $CH_2OH$, $CH_2CH_2OH$, $CH(OH)CH_3$, $CH(OH)CH_2OH$, $CH_2CH_2CH_2OH$, $CH_2CH(OH)CH_3$, $CH(OH)CH_2CH_3$, $CH(OH)CH_2CH_2OH$, $CH(OH)CH(OH)CH_3$, and $CH(OH)CH(OH)CH_2OH$, and the phenyl ring may optionally substituted with one or more further moieties such as $C_1$-$C_3$ alkyl groups but is preferably unsubstituted.

A particularly useful phenyl containing glycol ether solvent is commercially supplied as DOWANOL PPH, described to be a propylene glycol phenyl ether which is described by it supplier as being represented by the following structural representation (II):

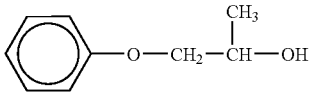

(II)

and further, indicated is that the major isomer is as indicated, which suggests that other alkyl isomers are also present.

The phenyl containing glycol ether solvent constituent may be a single phenyl containing glycol ether solvent, or may be a plurality of phenyl containing glycol ether solvents and is desirably present in the hard surface cleaning compositions of the invention in amounts of from about 0.01%-5% by weight, more desirably from about 0.01%-2% by weight, and most preferably from about 0.01-1% wt. based on the total weight of the compositions of which they form a part.

As recited previously, in certain preferred embodiments the phenyl containing glycol ether solvents are present solely with the alkanolamine in the compositions of the invention, to the exclusion of one or more further cosolvents.

Alternately in different preferred embodiments the phenyl containing glycol ether solvent constituent is used with one or more cosolvents based on organic solvents.

Contemplated as useful cosolvents are one or more useful organic solvents which include those which are water-miscible such as alcohols (e.g., low molecular weight alcohols, such as, for example, ethanol, propanol, isopropanol, and the like), glycols (such as, for example, ethylene glycol, propylene glycol, hexylene glycol, and the like), water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethylene glycol or propylene glycol (e.g. propylene glycol monomethyl ether acetate), and mixtures thereof. Glycol ethers having the general structure Ra—Rb—OH, wherein Ra is an alkoxy of 1 to 20 carbon atoms, Rb is an ether condensate of propylene glycol and/or ethylene glycol having from one to ten glycol monomer units. Mixtures of two or more specific organic solvents may be used, or alternately a single organic solvent may be provided as the organic solvent constituent. When present as cosolvents, of the foregoing classes of organic solvents, one or more alkyl glycol ethers or monohydric alcohols, especially $C_1$-$C_4$ alcohols are preferably used. One or more of said organic solvents may be provided as cosolvents. When present such cosolvent(s) may be present in amounts of up to about 5% wt, preferably are present in amounts of from about 0.01-3.5% wt. As stated previously however, in certain particularly preferred embodiments, such cosolvents are expressly excluded from the inventive compositions.

The hard surface cleaning compositions also provide a disinfecting and/or sanitizing benefit to hard surfaces treated with said compositions and the inventive compositions further comprise one or more antimicrobially active constituents which may provide such a disinfecting and/or sanitizing effect to the hard surface cleaning compositions of which they form a part. Such one or more antimicrobially active constituents are desirably effective against gram negative and/or gram positive bacteria, preferably against both, and should be selected to be compatible with the other constituents present in the composition.

Exemplary useful as antimicrobially active constituents are one or more cationic surfactants which are found to provide a broad antibacterial or sanitizing function. Any cationic surfactant which satisfies these requirements may be used and are considered to be within the scope of the present invention, and mixtures of two or more cationic surface active agents, viz., cationic surfactants may also be used. Cationic surfactants are well known, and useful cationic surfactants may be one or more of those described for example in *McCutcheon's Functional Materials, Vol.* 2, 1998; *Kirk-Othmer, Encyclopedia of Chemical Technology,* 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions include those which provide a germicidal effect to the concentrate compositions, and especially preferred are quaternary ammonium compounds and salts thereof, which may be characterized by the general structural formula:

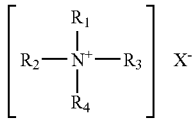

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful as antimicrobially active constituents in the practice of the present invention include those which have the structural formula:

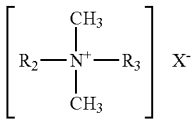

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include compositions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, McCutcheon's Functional Materials (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myrisalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

Wherein the inventive compositions include as part of the antimicrobially active constituent one or more germicidal cationic surfactant(s), such may present in any effective amount but are advantageously included in the hard surface cleaning compositions in amounts of from about 0.001% by weight to up to about 10% by weight, very preferably about 0.01-8% by weight, more preferably in amount of between 0.5-6% by weight, and most preferably from 2-4% by weight. When such are included, it is particularly advantageous that such germicidal cationic surfactant(s) are present in amounts of at least 200 parts per million (ppm), preferably in amounts of 200-700 ppm, more preferably in amounts of from 250-500 ppm, and very especially in amount of from 300-500 ppm.

Further exemplary useful compounds and materials which may be used in the antimicrobially active constituents other than then germicidal cationic surfactants noted above include one or more of one or more antimicrobial agents including: pyrithiones (especially zinc pyrithione which is also known as ZPT), dimethyldimethylol hydantoin (Glydant®), methylchloroisothiazolinone/methylisothiazolinone (Kathon CG®), sodium sulfite, sodium bisulfite, imidazolidinyl urea (Germall 115®), diazolidinyl urea (Germaill HO), benzyl alcohol, 2-bromo-2-nitropropane-1,3-diol (Bronopol®), formalin (formaldehyde), iodopropenyl butylcarbamate (Polyphase P100®), chloroacetamide, methanamine, methyldibromonitrile glutaronitrile (1,2-Dibromo-2,4-dicyanobutane or Tektamer®), glutaraldehyde, 5-bromo-5-nitro-1,3-dioxane (Bronidox®), phenethyl alcohol, o-phenylphenol/sodium o-phenylphenol, sodium hydroxymethylglycinate (Suttocide A®), polymethoxy bicyclic oxazolidine (Nuosept C®), dimethoxane, thimersal dichlorobenzyl alcohol, captan, chlorphenenesin, dichlorophene, chlorbutanol, glyceryl laurate, halogenated diphenyl ethers like 2,4,4'-trichloro-2'-hydroxy-diphenyl ether (Triclosan® or TCS), 2,2'-dihydroxy-5,5'-dibromo-diphenyl ether, phenolic compounds like phenol, 2-methyl phenol, 3-methyl phenol, 4-methyl phenol, 4-ethyl phenol, 2,4-dimethyl phenol, 2,5-dimethyl phenol, 3,4-dimethyl phenol, 2,6-dimethyl phenol, 4-n-propyl phenol, 4-n-butyl phenol, 4-n-amyl phenol, 4-tert-amyl phenol, 4-n-hexyl phenol, 4-n-heptyl phenol, mono- and poly-alkyl and aromatic halophenols such as p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, 5-chloro-2-hydroxy-diphenylmethane, resorcinol and its derivatives including methyl resorcinol, ethyl resorcinol, n-propyl resorcinol, n-butyl resorcinol, n-amyl resorcinol, n-hexyl resorcinol, n-heptyl resorcinol, n-octyl resorcinol, n-nonyl resorcinol, phenyl resorcinol, benzyl resorcinol, phenylethyl resorcinol, phenylpropyl resorcinol, p-chlorobenzyl resorcinol, 5-chloro 2,4-dihydroxydiphenyl methane, 4'-chloro 2,4-dihydroxydiphenyl methane, 5-bromo 2,4-dihydroxydiphenyl methane, and 4'-bromo 2,4-dihydroxydiphenyl methane, bisphenolic compounds like 2,2'-methylene bis(4-chlorophenol), 2,2'-methylene bis(3,4,6-trichlorophenol), 2,2'-methylene bis(4-chloro-6-bromophenol), bis(2-hydroxy-3,5-dichlorophenyl) sulphide, and bis(2-hydroxy-5-chlorobenzyl)sulphide, benzoic esters (parabens) like methylparaben, propylparaben, butylparaben, ethylparaben, isopropylparaben, isobutylparaben, benzylparaben, sodium methylparaben, and sodium propylparaben, halogenated carbanilides (e.g., 3,4,4'-trichlorocarbanilides (Triclocarban® or TCC), 3-trifluoromethyl-4,4'-dichlorocarbanilide, 3,3',4-trichlorocarbanilide, 2,4-dichloro-3,5-m-xylenol ("DCMX") as well as parachlorometacresol ("PCMC").

The one or more one antimicrobially active compounds or materials forming the antimicrobially active constituent may be present in any effective amount, but generally need not be present in amounts in excess of about 10% wt. based on the total weight of the composition. The one or more one antimicrobially active compounds or materials forming the antimicrobially active constituent are preferably present in amounts of from about from 0.001-3% wt., preferably in amounts from 0.1-2% wt., but are most desirably present from about 0.1-0.5% wt. based on the total weight of the inventive composition of which they form a part.

Notwithstanding the foregoing it is to be understood that according to certain preferred embodiments the hard surface cleaning compositions also provide a disinfecting and/or sanitizing benefit to hard surfaces treated with said compositions absent the presence of one or more antimicrobially active constituents which may provide such a disinfecting and/or sanitizing effect in the hard surface cleaning compositions of the invention, viz., said one or more said antimicrobially active constituents which may provide such a disinfecting and/or sanitizing effect are expressly omitted.

In certain preferred embodiments of the inventive composition where an antimicrobially active constituent is present, such expressly exclude germicidal cationic surfactants as described above, but include one or more antimicrobially active constituents as described above other than germicidal cationic surfactants.

In other preferred embodiments of the inventive composition where an antimicrobially active constituent is present, such expressly include germicidal cationic surfactants as described above, but exclude one or more antimicrobially active constituents other than germicidal cationic surfactants as described above.

Water is the primary constituent of the inventive compositions as the compositions are largely aqueous in nature, and comprise at least 75% wt., preferably at least about 80% wt. water, more preferably at least about 85% wt. water, still preferably at least about 88% wt., and in certain preferred embodiments comprise at least about 90% wt. water. The amount of water is added to order to provide to 100% by weight of the compositions of the invention. The water may be tap water, but is preferably distilled and is most preferably deionized water. If the water is tap water, it is preferably substantially free of any undesirable impurities such as organics or inorganics, especially minerals salts which are present in hard water which may thus undesirably interfere with the operation of the constituents present in the aqueous compositions according to the invention.

The compositions exhibit a pH in the range of 9 or greater, preferably 10 or greater, yet more preferably a pH of about 10.5-13 still more preferably a pH in the range of 10.5-12, and most preferably a pH in the range of 11-12.

As noted, the inventors have surprisingly observed that the present inventive compositions exhibit excellent cleaning of hard surfaces, particularly greasy soil laden hard surfaces. As is demonstrated in the following examples such is particularly surprising in highly aqueous compositions and particularly the absence of cosolvents based on known art water miscible volatile organic compositions.

As noted above, the inventors have also found that notwithstanding the highly hydrophobic nature of the phenyl containing glycol ether constituent, the highly alkaline hard surface cleaning compositions of the invention feature good storage stability characteristics both following freezing, as well as at elevated temperatures. Following freezing, and thawing to room temperature (20° C.) no phase separation of the phenyl containing glycol ether constituent from the largely aqueous compositions has been observed. Furthermore, no phase separation of the phenyl containing glycol ether constituent from the largely aqueous compositions has been observed following storage at 30° C., 40° C. and 50° C. for at least two weeks, preferably to at least 4 weeks at these elevated temperatures.

The compositions of the present invention can also optionally comprise one or more further constituents which are directed to improving the aesthetic or functional features of the inventive compositions. Such conventional additives known to the art include but not expressly enumerated here may also be included in the compositions according to the invention. By way of non-limiting example without limitation these may include: chelating agents, coloring agents, light stabilizers, fragrances, thickening agents, abrasives, hydrotropes, pH adjusting agents, pH buffers as well as other conventional additives known to the relevant art. Many of these materials are known to the art, per se, and are described in *McCutcheon's Detergents and Emulsifiers*, North American Edition, 1998; *Kirk-Othmer, Encyclopedia of Chemical Technology,* 4th Ed., Vol. 23, pp. 478-541 (1997. Such optional, i.e., non-essential constituents should be selected so to have little or no detrimental effect upon the desirable characteristics of the present invention.

Advantageously included constituents are one or more coloring agents which find use in modifying the appearance of the compositions and enhance their appearance from the perspective of a consumer or other end user. Known coloring agents, such as dyestuffs may be incorporated in the compositions in effective amounts.

The compositions of the invention optionally but in certain cases desirably include a fragrance constituent. Fragrance raw materials may be divided into three main groups: (1) the essential oils and products isolated from these oils; (2) products of animal origin; and (3) synthetic chemicals.

The essential oils consist of complex mixtures of volatile liquid and solid chemicals found in various parts of plants. Mention may be made of oils found in flowers, e.g., jasmine, rose, mimosa, and orange blossom; flowers and leaves, e.g., lavender and rosemary; leaves and stems, e.g., geranium, patchouli, and petitgrain; barks, e.g., cinnamon; woods, e.g., sandalwood and rosewood; roots, e.g., angelica; rhizomes, e.g., ginger; fruits, e.g., orange, lemon, and bergamot; seeds, e.g., aniseed and nutmeg; and resinous exudations, e.g., myrrh. These essential oils consist of a complex mixture of chemicals, the major portion thereof being terpenes, including hydrocarbons of the formula $(C_5H_8)_n$ and their oxygenated derivatives. Hydrocarbons such as these give rise to a large number of oxygenated derivatives, e.g., alcohols and their esters, aldehydes and ketones. Some of the more important of these are geraniol, citronellol and terpineol, citral and citronellal, and camphor. Other constituents include aliphatic aldehydes and also aromatic compounds including phenols such as eugenol. In some instances, specific compounds may be isolated from the essential oils, usually by distillation in a commercially pure state, for example, geraniol and citronellal from citronella oil; citral from lemon-grass oil; eugenol from clove oil; linalool from rosewood oil; and safrole from sassafras oil. The natural isolates may also be chemically modified as in the case of citronellal to hydroxy citronellal, citral to ionone, eugenol to vanillin, linalool to linalyl acetate, and safrol to heliotropin.

Animal products used in perfumes include musk, ambergris, civet and castoreum, and are generally provided as alcoholic tinctures.

The synthetic chemicals include not only the synthetically made, also naturally occurring isolates mentioned above, but also include their derivatives and compounds unknown in nature, e.g., isoamylsalicylate, amylcinnamic aldehyde, cyclamen aldehyde, heliotropin, ionone, phenylethyl alcohol, terpineol, undecalactone, and gamma nonyl lactone.

Fragrance compositions as received from a supplier may be provided as an aqueous or organically solvated composition, and may include as a hydrotrope or emulsifier a surface-active agent, typically a surfactant, in minor amount. Such fragrance compositions are quite usually proprietary blends of many different specific fragrance compounds. However, one of ordinary skill in the art, by routine experimentation, may easily determine whether such a proprietary fragrance composition is compatible in the compositions of the present invention.

The compositions of the invention may include one or more constituents which provide a thickening benefit to the compositions. The selection of such thickener constituent must of course take into consideration the highly alkaline nature of the compositions.

An exemplary class of useful thickeners include organic polymeric thickeners include polycarboxylate polymers having a molecular weight from about 500,000 to about 4,000,000, preferably from about 1,000,000 to about 4,000,000, with, preferably, from about 0.5% to about 4% crosslinking. Preferred polycarboxylate polymers include polyacrylate polymers including those sold under trade names Carbopol®, Acrysol® ICS-1 and Sokalan®. The preferred polymers are polyacrylates. Other monomers besides acrylic acid can be used to form these polymers including such monomers as ethylene and propylene which act as diluents, and maleic anhydride which acts as a source of additional carboxylic groups. Another example of polymeric based thickeners are those based on polyacrylamides. One example is Solagum from Seppic.

Another class of thickeners include colloid-forming clays, for example, such as smectite and/or attapulgite types. Inorganic colloid forming clays tend to provide higher stability in the presence of chlorine and do not thin when subjected to shear.

The clay materials can be described as expandable layered clays, i.e., aluminosilicates and magnesium silicates. The term "expandable" as used to describe the instant clays relates to the ability of the layered clay structure to be swollen, or expanded, on contact with water. The expandable clays used herein are those materials classified geologically as smectites (or montmorillonite) and attapulgites (or polygorskites). Smectites are three-layered clays. There are two distinct classes of smectite-type clays. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)(OH)_2$, for the aluminum and magnesium oxide type clays, respectively. It is to be recognized that the range of the water of hydration in the above formulas may vary with the processing to which the clay has been subjected.

Commercially available clays include, for example, montmorillonite (bentonite), volchonskoite, nontronite, beidellite, hectorite, saponite, sauconite and vermiculite. The clays herein are available under various trade names such as Gelwhite H NF and Gelwhite GP from Southern Clay Products. (both montmorillonites); Van Gel O from R. T. Vanderbilt, smectites, laponites and layered silicates from Southern Clay Products. A second type of expandable clay material useful in the instant invention is classified geologically as attapulgite (polygorskite). Attapulgites are magnesium-rich clays having principles of superposition of tetrahedral and octahedral unit cell elements different from the smectites. Like the smectites, attapulgite clays are commercially available. For example, such clays are marketed under the tradename Attagel, i.e. Attagel 40, Attagel 50 and Attagel 150 from Engelhard Minerals & Chemicals Corporation.

Another optional constituent of the present invention is at least one abrasive. Examples of abrasive materials include oxides, carbonates, quartzes, siliceous chalk, diatomaceous earth, colloidal silicon dioxide, alkali metasilicates, organic abrasive materials selected from polyolefins, polyethylenes, polypropylenes, polyesters, polystyrenes, acetonitrile-butadiene-styrene resins, melamines, polycarbonates, phenolic resins, epoxies and polyurethanes, natural materials selected from rice hulls, corn cobs, and the like, nepheline syenite, or talc and mixtures thereof. The particle size of the abrasive agent can range from about 1 μm to about 1000 μm, preferably between about 10 μm to about 200 μm, and more preferably between about 10 μm and about 100 μm. It is preferred to us those abrasive agents that will not scratch glass or ceramic surfaces. Such abrasive agents include calcium carbonate, siliceous chalk, diatomaceous earth, colloidal silicon dioxide, sodium metasilicate, talc, and organic abrasive materials. Calcium carbonate is preferred.

Ideally the inclusion of any further constituents which are directed to improving the aesthetic or functional features of the inventive compositions but should be minimized in order to minimize the likelihood of deleterious effects such as reduced cleaning benefit, or reduction in the stability of the compositions according to the invention. When one or more such optional constituents are present, preferably, in total they comprise not more than 10% wt., more preferably not more than 6% wt, still more preferably not more than 3.5% wt., and most preferably not more than about 2.5% wt of an inventive composition of which they form a part.

Particularly preferred compositions of the invention are hard surface cleaning compositions which exhibit a pH of 9 or more, preferably 10 or more and which comprise (preferably consist essentially of, more preferably consist of):

0.01-10% wt. of an amine oxide constituent, preferably a single amine oxide constituent, and especially preferably wherein the sole detersive surfactant present is an amine oxide constituent;

0-5% wt. of one or more further surfactants, preferably one or more nonionic surfactants which when present are cosurfactants;

0.01-10% wt. of an alkalinity constituent, especially a alkanolamine constituent, preferably a single monoalkanolamine selected from linear monoethanolamine, monopropanolamine or monobutanolamine, and especially preferably is monoethanolamine;

0.01-5% wt. of one or more phenyl containing glycol ether solvents;

0-5% wt. of one or more cosolvents;

0.001-10% wt. of one or more antimicrobially active constituents;

the balance to 100% wt. of water, preferably deionized water, wherein preferably water comprises at least 85% wt. of the total weight of the composition;

further optionally but in some cases preferably to 7% wt. of one or more further optional constituents which are directed to improving the aesthetic or functional features of the inventive compositions including coloring agents and fragrances.

In especially preferred compositions, the foregoing formulations expressly exclude the cosurfactants, or the cosolvents, but especially preferably exclude both the cosurfactants and cosolvents.

In certain especially preferred embodiments, the compositions of the invention necessarily include one or more antimicrobially active constituents.

The compositions of the inventions may be produced by simple mixing of the constituents in water, preferably at least a major proportion of the deionized water is provided at room temperature to which is added under constant stirring the surfactant constituent, followed by the organic solvent constituent, and finally any optional constituent which may be included. Mixing continues until a homogenous mixture of the constituents is formed, after which mixing may be stopped and the compositions are ready for use. These as mixed compositions are preferably used without further dilution prior to their use in the treatment of hard surfaces.

The alkaline hard surface cleaning composition according to the invention is desirably provided as a ready to use product which may be directly applied to a hard surface. By way of example, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, curtains, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone. Such hard surfaces described above are to be understood as being recited by way of illustration and not be way of limitation.

The compositions of the invention may be formulated so to be supplied in as non-pressurized containers such as rigid containers or flasks, as well as in deformable containers or flask from which the inventive compositions may be dispensed. The non-pressurized containers may be provided with a conventional trigger-pump spray apparatus which when actuated by a user, is used to withdraw a quantity of the composition from the container and expel it from the trigger-pump spray apparatus as a spray or stream which may be directed to a hard surface in need of treatment.

The compositions of the invention may be formulated with conventional propellants for dispensing as aerosols from conventional pressurized containers. Propellants which may be used are well known and conventional in the art and include, for example, a hydrocarbon, of from 1 to 10 carbon atoms, such as n-propane, n-butane, isobutane, n-pentane, isopentane, and mixtures thereof; dimethyl ether and blends thereof as well as individual or mixtures of chlorofluoro- and/or fluorohydrocarbons- and/or hydrochlorofluorocarbons (HCFCs). Useful commercially available hydrocarbon based propellant compositions include A-70 (Aerosol compositions with a vapor pressure of 70 psig available from companies such as Diversified and Aeropress.), as well as fluorocarbon based propellant compositions such as DYMEL 152A (commercially available from DuPont.) Compressed gases such as carbon dioxide, compressed air, nitrogen, and possibly dense or supercritical fluids may also be used.

The amount of propellant employed should provide a suitable spray pattern and for essentially complete expulsion of the composition from the aerosol container. The appropriate amount to be used for any particular aerosol propellant system can readily be determined by one skilled in the art. Preferably, the propellants comprise about 1% to about 50% of the aerosol formulation with preferred amounts being from about 2% to about 25%, more preferably from about 5% to about 15%. Generally speaking, the amount of a particular propellant employed should provide an internal pressure of from about 20 to about 150 psig at 70° F.

The composition of the present invention, can also be applied to a hard surface by using a wet wipe preimpreganted with a quantity of the inventive composition. The wipe can be of a woven or non-woven nature. Fabric substrates can include nonwoven or woven pouches, sponges, in the form of abrasive or non-abrasive cleaning pads. Such fabrics are known commercially in this field and are often referred to as wipes. Such substrates can be resin bonded, hydroentangled, thermally bonded, meltblown, needlepunched, or any combination of the former.

Such nonwoven fabrics may be a combination of wood pulp fibers and textile length synthetic fibers formed by well known dry-form or wet-lay processes. Synthetic fibers such as rayon, nylon, orlon and polyester as well as blends thereof can be employed. The wood pulp fibers should comprise about 30 to about 60 percent by weight of the nonwoven fabric, preferably about 55 to about 60 percent by weight, the remainder being synthetic fibers. The wood pulp fibers provide for absorbency, abrasion and soil retention whereas the synthetic fibers provide for substrate strength and resiliency. The substrate of the wipe may also be a film forming material such as a water soluble polymer. Such self-supporting film substrates may be sandwiched between layers of fabric substrates and heat sealed to form a useful substrate. The free standing films can be extruded utilizing standard equipment to devolatilize the blend. Casting technology can be used to form and dry films or a liquid blend can be saturated into a carrier and then dried in a variety of known methods.

The compositions of the present invention are absorbed onto the wipe to form a saturated wipe. The wipe can then be sealed individually in a pouch which can then be opened when needed or a multitude of wipes can be placed in a container for use on an as needed basis. The container, when closed, sufficiently sealed to prevent evaporation of any components from the compositions.

The compositions are readily used in the cleaning of hard surfaces by application a cleaning effective amount of a hard surface cleaning composition according to any of the prior recited inventive aspects to a hard surface in need of such treatment, and concurrently or subsequently, wiping the surface with a cloth, wipe or wiping article.

The following examples exhibit exemplary and preferred formulations of the invention. It is to be understood that these examples are provided by way of illustration only and that further useful formulations falling within the scope of the present invention and the claims may be readily produced by one skilled in the art without deviating from the scope and spirit of the invention.

EXAMPLES

Formulation according to the invention were produced by mixing the constituents outlined in Table 1 by adding the individual constituents into a beaker of deionized water at room temperature which was stirred with a conventional magnetic stirring rod. Stirring continued until each of the formulations were homogenous in appearance. It is to be noted that the constituents might be added in any order, but it is preferred that a major proportion of water be the initial constituent provided to a mixing vessel or apparatus as it is the major constituent and addition of the further constituents thereto is convenient.

TABLE 1

| | E1 | E2 | E3 | E4 |
|---|---|---|---|---|
| benzalkonium chloride (80%) | 0.027 | — | 0.027 | — |
| benzalkonium chloride (50%) | 0.172 | 0.05 | 0.172 | — |
| didecyl dimethyl ammonium chloride (50%) | — | — | — | 0.4 |
| lauryl dimethyl amine oxide (30%) | 3.50 | 3.5 | 3.5 | 3.5 |
| propylene glycol phenyl ether | 0.80 | 0.8 | 0.8 | 0.8 |
| monoethanolamine | 0.75 | 0.75 | 0.75 | 0.75 |
| fragrance (proprietary composition) | 0.20 | 0.2 | 0.2 | 0.2 |
| colorant | — | — | 0.05 | — |
| water (deionized) | q.s. | q.s. | q.s. | q.s. |

The quantity of each identified constituents used to produce the formulations of Table 1 is indicated in weight percent, and the indicated amounts are based on the "as supplied" constituents, which may have been less than 100% wt. "actives". In such instances the named constituent is followed by the percentage of % wt. actives, in parenthesis, provided in the "as supplied" constituent. Constituents which are not indicated with a corresponding percentage of % wt. actives, in parenthesis, are to be considered as 99%-100% wt. "active". Also, as indicated deionized water was added to each formulation in quantum sufficient, "q.s." to provide the balance to 100% wt. of each of the example compositions.

Several comparative compositions were also prepared in the same manner as the compositions according to those indicated on Table 1, and had the following constituents as indicated on Table 2.

TABLE 2

| | C1 | C2 | C3 |
|---|---|---|---|
| benzalkonium chloride (80%) | 0.027 | 0.027 | 0.027 |
| benzalkonium chloride (50%) | 0.172 | 0.172 | 0.172 |
| lauryl dimethyl amine oxide (30%) | 3.5 | 3.5 | 2 |
| propylene glycol phenyl ether | — | — | — |
| propylene glycol n-propyl ether | — | 0.8 | — |
| dipropylene glycol n-butyl ether | — | — | 1.0 |
| n-decanol | — | — | 0.02 |
| monoethanolamine | 0.75 | 0.75 | 0.75 |
| fragrance (proprietary composition) | 0.20 | 0.2 | 0.02 |
| water (deionized) | q.s. | q.s. | q.s. |

The constituents used to form the examples as well as the comparative example are identified more fully on the following Table 3.

TABLE 3

| | |
|---|---|
| lauryl dimethyl amine oxide (30%) | lauryl dimethyl amine oxide, 30% wt. actives, supplied as Ammonyx LO (ex. Stepan Co.) |
| propylene glycol phenyl ether | propylene glycol phenyl ether, supplied as Dowanol PPH (ex. Dow Chem. Co.) |
| propylene glycol n-propyl ether | propylene glycol n-propyl ether, 100% wt. actives, supplied as Downol PnP (ex. Dow Chem. Co.) |
| dipropylene glycol | dipropylene glycol n-butyl ether, |

TABLE 3-continued

| | |
|---|---|
| n-butyl ether | 100% wt. actives, supplied as Dowanol DPnB (ex. Dow Chem. Co.) |
| n-decanol | n-decanol, 100% wt. actives, laboratory grade |
| monoethanolamine | monoethanolamine, 100% wt. actives, supplied as MEA LCI (ex. Huntsman Co.) |
| benzalkonium chloride (80%) | benzalkonium chloride, 80% wt. actives, supplied as BTC-8358 (ex. Stepan Co.) |
| benzalkonium chloride (50%) | benzalkonium chloride, 50% wt. actives, supplied as BTC-65 (ex. Stepan Co.) |
| didecyl dimethyl ammonium chloride (50%) | didecyl dimethyl ammonium chloride, 50% wt. actives |
| fragrance (proprietary composition) | proprietary composition |
| colorant | 1% w/w aqueous solution of FD&C Yellow #5 in deionized water |
| water (deionized) | deionized water |

Cleaning of Organic Soil

Cleaning evaluations were performed in accordance with the testing protocol outlined according to ASTM D4488 A2 Test Method, which evaluated the efficacy of the cleaning compositions in removing a standardized greasy organic soil on masonite wallboard samples painted with white wall paint. The soil applied was a standardized greasy soil containing:

| Test Greasy Soil | % w/w |
|---|---|
| vegetable oil | 33 |
| vegetable shortening | 33 |
| lard | 33 |
| carbon black | 1 |

which were blended together to homogeneity under gentle heating to form a uniform mixture which was later allowed to cool to room temperature. The sponge (water dampened) of a Gardner Abrasion Tester apparatus was squirted with a 15 gram sample of a tested cleaning composition, and the apparatus was cycled 2 times. The test was replicated 4 times for each tested composition. The tiles were dried, and then the cleaning efficacy was evaluated. The cleaning efficacy of the tested compositions was evaluated utilizing a Minolta Chroma Meter CR-400, with Data Processor DP-100, which evaluated spectrophotomic characteristics of the sample.

The percentage of the test greasy soil removal from each tile was determined utilizing the following equation:

$$\% \text{ Removal} = \frac{RC - RS}{RO - RS} \times 100$$

where

RC=Reflectance of tile after cleaning with test product

RO=Reflectance of original soiled tile

RS=Reflectance of soiled tile

The results of this evaluation was averaged for each of the tested compositions, and the results of the evaluation are reported on the following table.

The results are reported on Table 4, following.

TABLE 4

| Composition | Average % Soil Removal |
|---|---|
| E1 | 89.34 |
| C1 | 76.37 |
| C2 | 74.90 |
| C3 | 82.67 |

With respect to the results reported on Table 4 a value of "100" is indicative of total soil removal and a "0" value is indicative no soil removal. As can be seen from the results of Table 4, the cleaning efficacy of the composition according to the invention provided significantly superior results that that provided by the comparative composition, C1 which included no solvent, C2 which.

Evaluation of Antimicrobial Efficacy:

The composition E4 was evaluated in order to evaluate its antimicrobial efficacy against *Staphylococcus aureus* (gram positive type pathogenic bacteria) (ATCC 6538), *Escheria coli* (gram negative type pathogenic bacteria) (ATCC 11229), *Pseudomonas aeruginosa* (ATCC 15442). The testing was performed in accordance with the protocols outlined in AOAC Official Method 961.02 "Germicidal Spray Products as Disinfectants", as described in AOAC Official Methods of Analysis, 16th Ed., (1995).

As is appreciated by the skilled practitioner in the art, the results of the AOAC Germicidal Spray Test indicates the number of test substrates wherein the tested organism remains viable after contact for 10 minutes with a test disinfecting composition/total number of tested substrates (slides) evaluated in accordance with the AOAC Germicidal Spray Test. Thus, a result of "0/20" indicates that of 20 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the testing are indicated on Table 5, below. The reported results indicate the number of test cylinders with live test organisms/number of test cylinders tested for each example formulation and organism tested.

TABLE 5

| E4 | Test Results | Conclusion |
|---|---|---|
| *Staphylococcus aureus* | 0/20 | pass |
| *Salmonella choleraesuis* | 0/20 | pass |
| *Pseudomonas aeruginosa* | 0/20 | pass |

The composition E1 was screened in order to evaluate its antimicrobial efficacy against *Staphylococcus aureus* (gram positive type pathogenic bacteria) (ATCC 6538), *Salmonella enterica* (ATCC 10708), and *Pseudomonas aeruginosa* (ATCC 15442). The testing was performed in accordance with the protocols outlined in AOAC Official Method 961.02 "Germicidal Spray Products as Disinfectants", as described in AOAC Official Methods of Analysis, 16th Ed., (1995).

As is appreciated by the skilled practitioner in the art, the results of the AOAC Germicidal Spray Test indicates the number of test substrates wherein the tested organism remains viable after contact for 10 minutes with a test disinfecting composition/total number of tested substrates (slides) evaluated in accordance with the AOAC Germicidal Spray Test. Thus, a result of "0/10" indicates that of 10 test substrates bearing the test organism and contacted for 10 minutes in a test disinfecting composition, 0 test substrates had viable (live) test organisms at the conclusion of the test. Such a result is excellent, illustrating the excellent disinfecting efficacy of the tested composition.

Results of the testing are indicated on the following Table 6; the reported results indicate the number of test cylinders with live test organisms/number of test cylinders tested for each example formulation and organism tested.

TABLE 6

| E4 | Test Results | Conclusion |
|---|---|---|
| *Staphylococcus aureus* | 0/10 | pass |
| *Salmonella choleraesuis* | 0/10 | pass |
| *Pseudomonas aeruginosa* | 0/10 | pass |

As may be seen from the results indicated above, the compositions according to the invention provide excellent cleaning benefits to hard surfaces, including hard surfaces with difficult to remove stains. These advantages are further supplemented by the excellent antimicrobial efficacy of these compositions against known bacteria commonly found in bathroom, kitchen and other environments. Such advantages clearly illustrate the superior characteristics of the compositions, the cleaning and antimicrobial benefits attending its use which is not before known to the art.

While the invention is susceptible of various modifications and alternative forms, it is to be understood that specific embodiments thereof have been shown by way of example which are not intended to limit the invention to the particular forms disclosed; on the contrary the intention is to cover all modifications, equivalents and alternatives falling within the scope and spirit of the invention as expressed in the appended claims.

The invention claimed is:

1. An alkaline hard surface cleaning composition having a pH of at least 10.5 which composition comprises a cleaning effective amount of an amine oxide surfactant constituent which amine oxide surfactant is the sole detersive surfactant present in the composition and wherein the composition is essentially free of cosurfactants;

an alkanolamine constituent;

a phenyl containing glycol ether solvent which is the sole organic solvent present in the composition:

an antimicrobially active constituent;

water; and, further optionally, minor amounts of one or more constituents which improve one or more aesthetic or functional characteristics of the inventive compositions;

wherein the composition excludes cosolvents selected from alcohols, glycols, water-miscible ethers, water-miscible glycol ethers, lower esters of monoalkylethers of ethylene glycol or propylene glycol, glycol ether having the general structure Ra-Ob-OH wherein Ra is an alkoxy of 1-20 carbon atoms and Rb is an ether condensate of propylene glycol and/or ethylene glycol having from one to ten glycol monomer units.

2. An alkaline hard surface cleaning composition according to claim 1 which comprises:

0.01-10% wt. of a single amine oxide constituent;

0.01-10% wt. of an alkanolamine constituent;

0.01-5% wt. of one or more phenyl containing glycol ether solvents;

0.001-10% wt. of one or more antimicrobially active constituents;

water in an amount of at least 85% wt. of the total weight of the composition;

optionally to 7% wt. of one or more further optional constituents which are directed to improving the aesthetic or functional features of the inventive compositions including coloring agents and fragrances.

3. An alkaline hard surface cleaning composition according to claim 1 wherein as an alkalinity constituent, one or more of an alkanolmine, carbonate an/or bicarbonate compound is used.

4. An alkaline ready to use composition packaged in a non-pressurized container comprising a composition according to claim 1.

5. An alkaline ready to use composition packaged in a pressurized aerosol container comprising a composition according to claim 1.

6. An alkaline preimpregnated wet wipe article comprising a composition according to claim 1.

7. A method of cleaning a hard surface in need of a cleaning treatment which method comprises the step of:

applying an effective amount of the composition according to claim 1 with a wiping article.

8. An alkaline hard surface cleaning composition according to claim 1 which consists of:

0.01-10% wt. of an amine oxide constituent as the sole detersive surfactant present in the composition;

0.01-10% wt. of a single alkanolamine constituent, selected from: linear monoethanolamine, monopropanolamine and monobutanolamine;

0.01-5% wt. of one or more phenyl containing glycol ether solvents;

0.001-10% wt. of one or more antimicrobially active constituents;

the balance to 100% wt. of water, wherein water comprises at least 85% wt. of the total weight of the composition;

optionally to 7% wt. of one or more further optional constituents which are directed to improving the aesthetic or functional features of the inventive compositions including coloring agents and fragrances:

wherein the composition excludes cosolvents selected from alcohols, glycols, water-miscible ethers, water-miscible glycol ethers, lower esters of monoalkylethers of ethylene glycol or propylene glycol, glycol ethers having the general structure Ra-Ob-OH wherein Ra is an alkoxy of 1-20 carbon atoms and Rb is an ether condensate of propylene glycol and/or ethylene glycol having from one to ten glycol monomer units.

9. An alkaline hard surface cleaning composition according to claim 1 having a pH in the range of 10.5-13.

10. An alkaline hard surface cleaning composition according to claim 9 having a pH in the range of 10.5-12.

11. An alkaline hard surface cleaning composition according to claim 10 having a pH in the range of 11-12.

12. An alkaline hard surface cleaning composition according to claim 1, wherein the antimicrobially active constituent is a quaternary ammonium compounds and salts thereof, which may be characterized by the general structural formula:

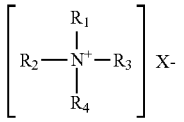

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165.

13. An alkaline hard surface cleaning composition according to claim 1, wherein the antimicrobially active constituent is a microbicidal agent other than quaternary ammonium compounds and salts.

* * * * *